US009316132B2

(12) United States Patent
Mc Donald

(10) Patent No.: US 9,316,132 B2
(45) Date of Patent: Apr. 19, 2016

(54) SYSTEM AND METHOD FOR MONITORING ENGINE OIL LEVELS

(75) Inventor: Mike M. Mc Donald, Macomb, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 186 days.

(21) Appl. No.: 13/082,798

(22) Filed: Apr. 8, 2011

(65) Prior Publication Data

US 2012/0259501 A1 Oct. 11, 2012

(51) Int. Cl.
*F01M 11/12* (2006.01)

(52) U.S. Cl.
CPC ..... *F01M 11/12* (2013.01)

(58) Field of Classification Search
CPC ..... F01M 11/12
USPC ..... 701/35
See application file for complete search history.

(56) References Cited

U.S. PATENT DOCUMENTS 1,432,346 A * 10/1922 Lorenz ..... 340/870.11
3,846,747 A * 11/1974 Arai et al. ..... 340/450.3
4,023,137 A * 5/1977 Olsbo et al. ..... 340/450.3
4,367,462 A * 1/1983 Dressler ..... 340/620
4,503,419 A * 3/1985 Kidd et al. ..... 340/450.3
5,019,800 A * 5/1991 Gallert ..... 340/450.3
5,060,608 A 10/1991 Umemoto
5,159,313 A * 10/1992 Kawai ..... F01M 11/10 123/196 S
5,369,396 A * 11/1994 Kurata ..... F01M 11/12 340/450.3
5,831,154 A * 11/1998 Guertler ..... F01M 11/12 701/29.5
5,908,985 A * 6/1999 Maatuk ..... 73/295
6,301,947 B1 * 10/2001 McCombs, Jr. ..... 72/295
6,429,773 B1 * 8/2002 Schuyler ..... 340/425.5
6,640,644 B1 11/2003 Mireles et al.
6,694,285 B1 2/2004 Choe et al.
6,768,938 B2 7/2004 McBrien et al.
6,914,524 B2 * 7/2005 Berndorfer ..... F01M 1/18 340/439
7,129,715 B2 * 10/2006 Hayashi et al. ..... 324/685
7,433,770 B2 10/2008 Inagawa et al.
8,401,760 B2 3/2013 Payne et al.
2002/0177960 A1 * 11/2002 Berndorfer ..... 702/50
2003/0060949 A1 * 3/2003 Letang et al. ..... 701/29
2006/0037387 A1 2/2006 Utz et al.
2007/0113646 A1 * 5/2007 Maatuk ..... 73/295
2007/0169549 A1 * 7/2007 Kwun et al. ..... 73/290 V
2009/0076677 A1 3/2009 Walthall et al.
2009/0188755 A1 7/2009 Staley et al.

(Continued)

FOREIGN PATENT DOCUMENTS

CN 101233302 A 7/2008

OTHER PUBLICATIONS

Article entitled "Technical Information Electronics—Oil Sensors", Hella KGaA Hueck & Co., 8 pages, found at http://www.hella.com/produktion/HellaUSA/WebSite/MiscContent/Download/AutoIndustry/Electronics/TI_Oelsensorik_GB_TT_05.pdf, date believed to be Aug. 29, 2005 (based on properties of online document).

Article entitled, "2009 Audi S5: Oil Level", Jason Kavanagh, Engineering Editor, Mar. 17, 2010, 3 pages, found at <http://www.edmunds.com/audi/s5/2009/long-term-road-test/2009-audi-s5-oil-level.html>.

(Continued)

*Primary Examiner* — Bao Long T Nguyen

(57) ABSTRACT

A system includes a user interface module, a level determination module, and a level storage module. The user interface module outputs an oil level request based on user input. The level determination module determines N oil levels of an engine. N is an integer greater than one. The level storage module stores the N oil levels and outputs one of the N oil levels in response to the oil level request.

22 Claims, 5 Drawing Sheets

(56) References Cited

U.S. PATENT DOCUMENTS

| | | | | |
|---|---|---|---|---|
| 2012/0125442 | A1* | 5/2012 | Sutherland et al. | 137/2 |
| 2012/0259501 | A1 | 10/2012 | Mc Donald | |
| 2013/0080022 | A1 | 3/2013 | Mc Donald | |
| 2013/0227960 | A1 | 9/2013 | Bonner | |

OTHER PUBLICATIONS

Article entitled, "2009 BMW 7 Series Long Term Road Test, 2009 BMW 750i: Engine Oil Level at minimum!", Albert Austria, Senior Engineer, Feb. 1, 2010, 1 page, article found at: <http://www.edmunds.com/bmw/7-series/2009/long-term-road-test/2009-bmw-750i-engine-oil-level-at-minimum.html>.

* cited by examiner

SYSTEM AND METHOD FOR MONITORING ENGINE OIL LEVELS

FIELD

The present disclosure relates to engine control systems and methods, and more particularly, to systems and methods for monitoring engine oil levels.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Engine oil is typically circulated in an engine to lubricate moving components in the engine. Typically, an oil pump pumps the engine oil from an oil sump to various other locations within the engine. Gravity causes engine oil to return to the oil sump. When the engine is switched off, the oil pump no longer pumps the engine oil, and therefore a substantial portion of the engine oil returns to and remains in the oil sump.

The engine oil must be maintained above a certain level to prevent damage to the engine components while the engine is running. Methods have been developed in which an operator manually checks an engine oil level when the engine switched is off by withdrawing a dipstick from the oil sump and observing the amount of oil deposited on the dipstick. However, these methods rely on the operator to check the engine oil level, and therefore may result in infrequent oil level checks, low or high engine oil levels, and ultimately, damage to the engine and/or to an emission control system.

SUMMARY

A system includes a user interface module, a level determination module, and a level storage module. The user interface module outputs an oil level request based on user input. The level determination module determines N oil levels of an engine. N is an integer greater than one. The level storage module stores the N oil levels and outputs one of the N oil levels in response to the oil level request.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
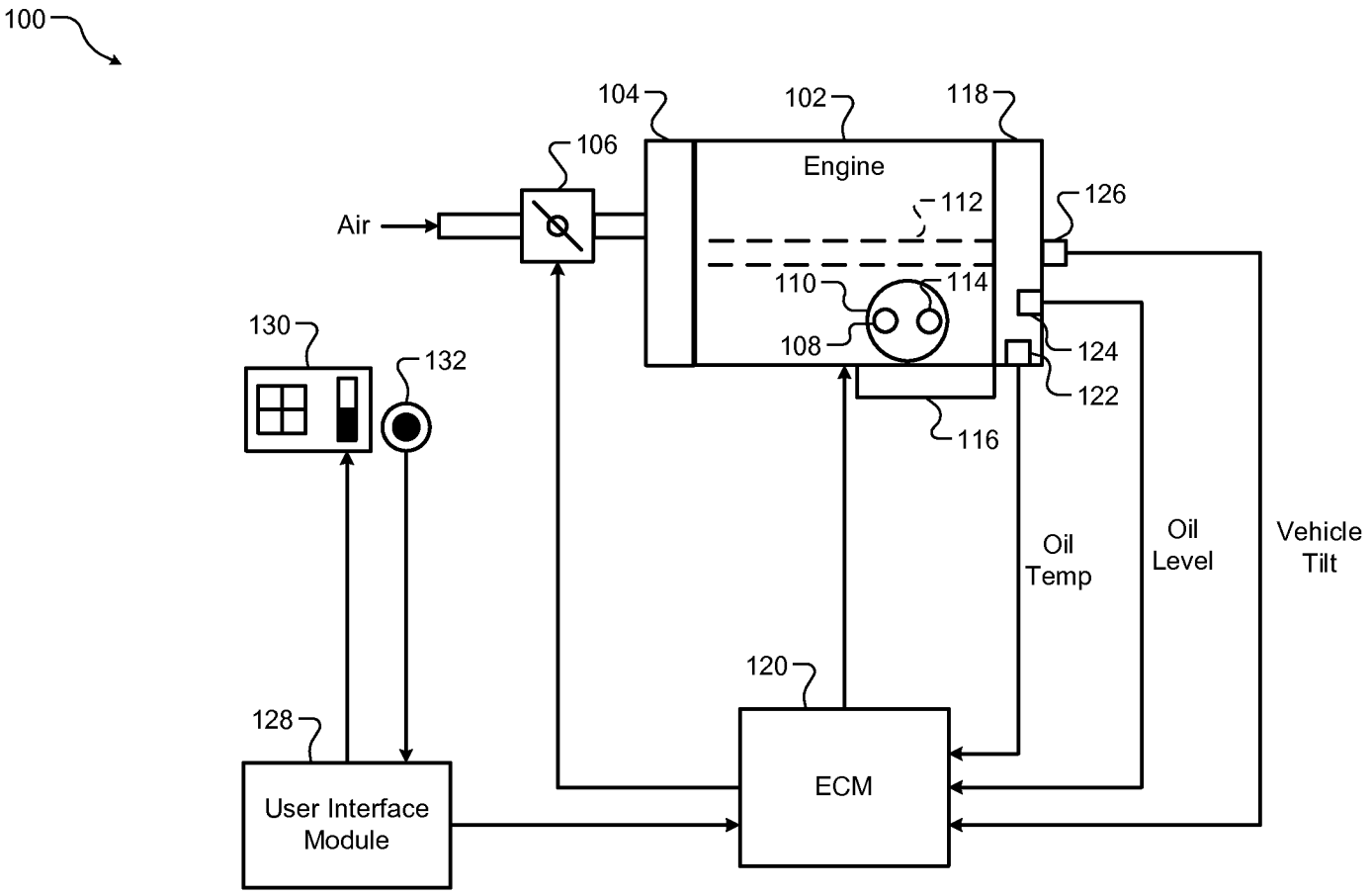
FIG. 1 is a functional block diagram of an example engine system according to the principles of the present disclosure.

The following description is merely illustrative in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module may refer to, be part of, or include an Application Specific Integrated Circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

An engine oil level monitoring system and method according to the principles of the present disclosure automatically checks an oil level of an engine, enables a user to request an oil level check, and displays the oil level in response to the user's request. The oil level may be measured using an oil level sensor. The user may request the oil level using an instrument panel, a mobile device, and/or the internet. The oil level may be determined based on oil monitoring conditions in response to the user's request.

The oil monitoring conditions may include an oil temperature, an engine-off time, and/or a vehicle tilt. The oil level may be determined when the oil temperature is greater than a predetermined temperature, the engine-off time is greater than a drain time, and/or the vehicle tilt is less than a predetermined angle. The oil level may be modified based on the oil temperature, which may be measured using a temperature sensor. Oil is allowed to drain into an oil reservoir during the drain time, which may be determined based on the oil temperature, an engine type, and/or an oil viscosity grade.

Referring now to FIG. 1, a functional block diagram of an example engine system 100 is presented. An engine 102 generates drive torque for a vehicle. While the engine 102 is shown and will be discussed as a spark-ignition, the engine 102 may be another suitable type of engine, such as a compression-ignition engine.

Air is drawn into the engine 102 through an intake manifold 104. Airflow into the engine 102 may be varied using a throttle valve 106. One or more fuel injectors, such as a fuel injector 108, mix fuel with the air to form an air/fuel mixture. The air/fuel mixture is combusted within cylinders of the engine 102, such as a cylinder 110. Although the engine 102 is depicted as including one cylinder, the engine 102 may include more than one cylinder.

The cylinder 110 includes a piston (not shown) that is mechanically linked to a crankshaft 112. One combustion cycle within the cylinder 110 may include four phases: an intake phase, a compression phase, a combustion phase, and an exhaust phase. During the intake phase, the piston moves toward a bottommost position and draws air into the cylinder 110. During the compression phase, the piston moves toward a topmost position and compresses the air or air/fuel mixture within the cylinder 110.

During the combustion phase, spark from a spark plug 114 ignites the air/fuel mixture. The combustion of the air/fuel mixture drives the piston back toward the bottommost position, and the piston drives rotation of the crankshaft 112. Resulting exhaust gas is expelled from the cylinder 110 through an exhaust manifold 116 to complete the exhaust phase and the combustion cycle. The engine 102 outputs torque to a transmission (not shown) via the crankshaft 112.

An oil reservoir 118, such as an oil sump, stores oil that lubricates moving parts in the engine 102, and may be located at or near the bottom of the engine 102. When the engine 102 is running, an oil pump (not shown) may pump oil from the oil reservoir 118 to other locations in the engine 102. Gravity may cause oil to return to the oil reservoir 118. When the engine 102 is switched off, the oil pump may stop pumping oil, and a substantial portion of the oil may return to and remain in the oil reservoir 118.

An engine control module (ECM) 120 controls the throttle valve 106, the fuel injector 108, and the spark plug 114, and determines a tilt angle, an oil temperature, and an oil level of the engine 102 based on inputs received from one or more sensors. The ECM 120 may control the throttle valve 106, the fuel injector 108, and the spark plug 114 based on the oil level of the engine 102. For example, the ECM 120 may limit the speed of the engine 102 when the oil level is low.

The sensors may include a temperature sensor 122, an oil level sensor 124, and a tilt sensor 126. The temperature sensor 122 measures the temperature of oil in the engine 102 and outputs an oil temperature signal indicating the oil temperature. The oil level sensor 124 measures the level of oil in the engine 102 and outputs an oil level signal indicating the oil level. The tilt sensor 126 measures the tilt of the vehicle with respect to gravity and outputs a vehicle tilt signal indicating the vehicle tilt.

The temperature sensor 122 and the oil level sensor 124 may be integrated into one sensor. The oil level sensor 124 may be located at the bottom of the oil reservoir 118 and may measure the oil level by transmitting an ultrasonic wave into oil in the oil reservoir. The oil level sensor 124 may measure the time that elapses while the ultrasonic wave is reflected back to the oil level sensor 124 from a top surface of the oil. The oil level sensor 124 may measure the oil level based on the elapsed time.

A user interface module (UIM) 128 enables a user to request an oil level check and displays the oil level to the user using a display 130, such as a touchscreen. The UIM 128 and/or the display 130 may be included in an instrument panel, a mobile device, a laptop, or a desktop computer. The UIM 128 outputs the user's request to the ECM 120 using a wired or wireless signal, and the ECM 120 outputs the oil level to the UIM 128 in response to the user's request using a wired or wireless signal.

An ignition key or button 132 enables the user to start and stop the engine 102. The ignition key or button 132 may output an engine start/stop signal to the UIM 128, which may relay the engine start/stop signal to the ECM 120. Alternatively, ignition key or button 132 may output an engine start/stop signal directly to the ECM 120. The ECM 120 starts and stops the engine 102 in response to the engine start/stop signal.

Figure 2:
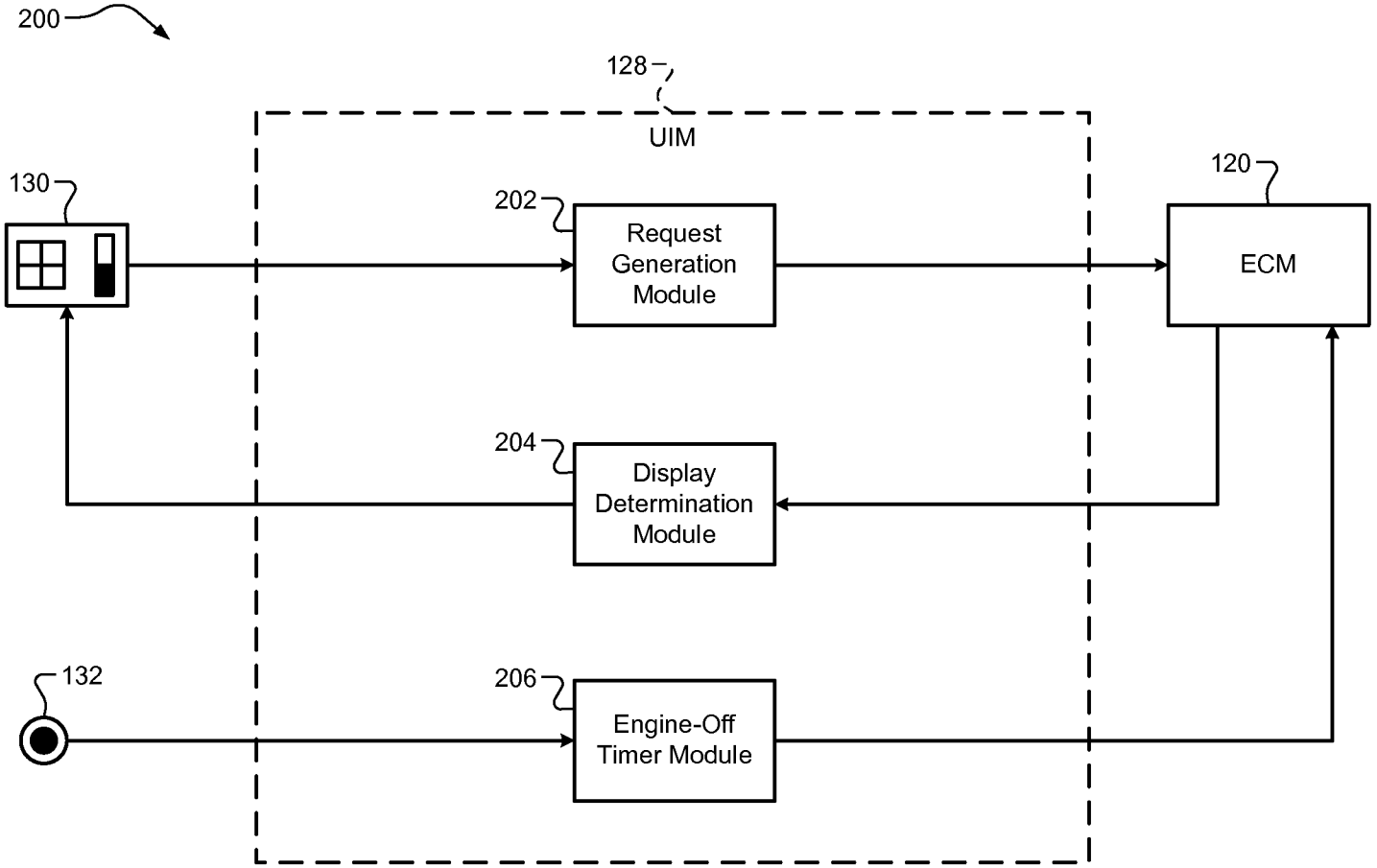
FIG. 2 is a functional block diagram of an example user interface module according to the principles of the present disclosure.

Referring now to FIG. 2, an engine oil level monitoring system 200 includes the ECM 120, the UIM 128, and the display 130. The UIM 128 includes a request generation module 202, a display determination module 204, and an engine-off timer module 206. The request generation module 202 receives user input from the display 130 and generates an oil level request based on the user input.

The request generation module 202 outputs the oil level request to the ECM 120, and the ECM 120 outputs an oil level to the display determination module 204 in response to the oil level request. The oil level request may be a previous level request or a present level request. The previous level request requests a previous oil level, which may be the oil level most recently measured. The present level request requests a present oil level, which may be measured when oil level monitoring conditions satisfy certain criteria, such as when the engine 102 is off for a predetermined amount of time and the vehicle is level.

The display determination module 204 controls the display 130 to display the oil level received from the ECM 120. When a present oil level is requested, the ECM 120 may inform the display determination module 204 that the ECM 120 accepts the present level request. In turn, the display determination module 204 may control the display 130 to display a user message acknowledging the present level request. For example, the user message may instruct the user to park the vehicle on level ground and inform the user that an oil level check will occur at the next opportunity after the engine 102 is shut off.

The engine-off timer module 206 determines an engine-off time, which starts when the engine 102 is switched off and may stop when the engine 102 is switched on. The engine-off timer module 206 may determine the engine-off time based on input received from the ignition key or button 132. For example, the engine-off timer module 206 may start incrementing the engine-off time when the ignition key or button 132 is pressed to switch the engine 102 off. The engine-off timer module 206 may output the engine-off time to the ECM 120.

Figure 3:
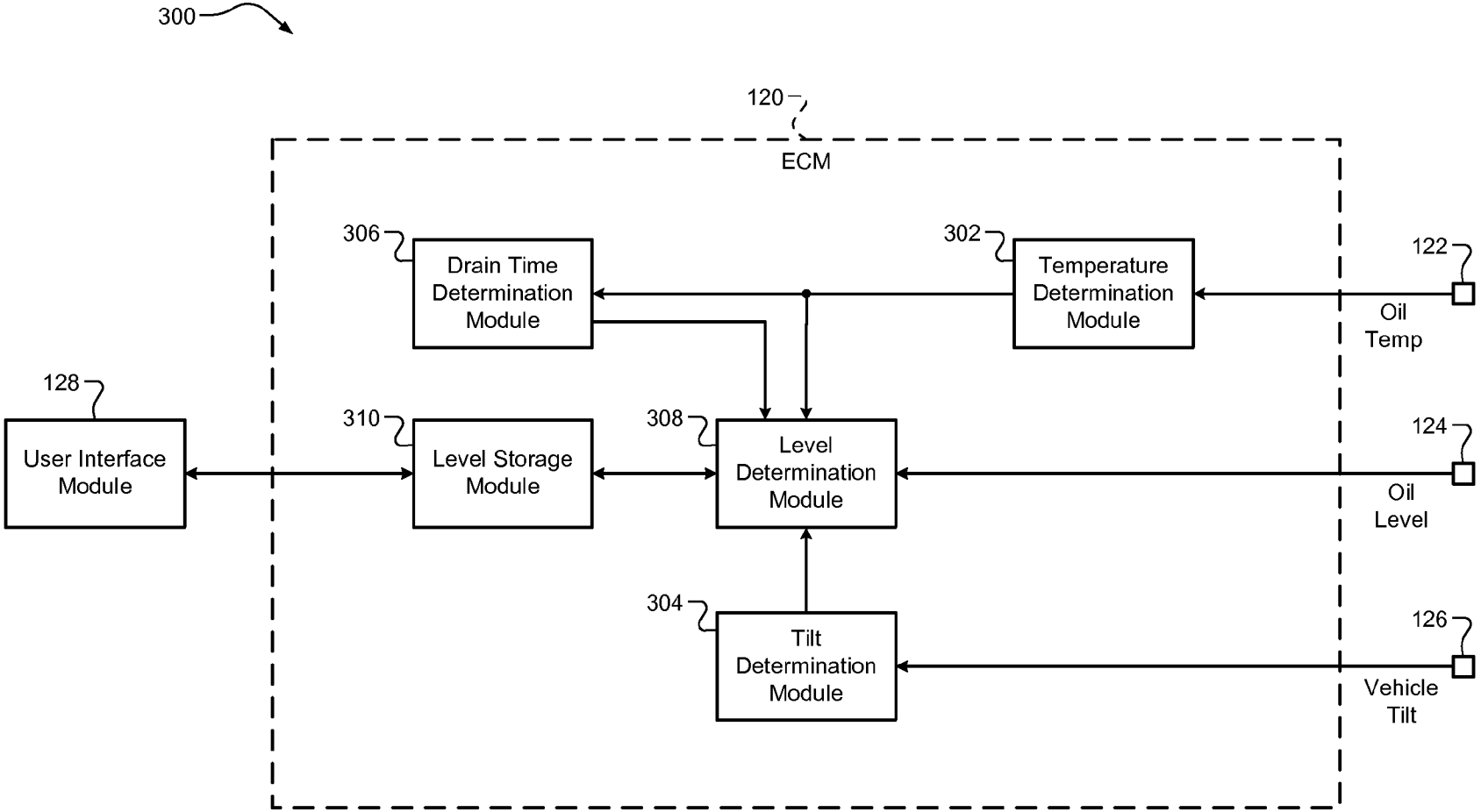
FIG. 3 is a functional block diagram of an example engine control module according to the principles of the present disclosure.

Referring now to FIG. 3, an engine oil level monitoring system 300 includes the ECM 120, the temperature sensor 122, the oil level sensor 124, the tilt sensor 126, and the UIM 128. The systems 200, 300 may be integrated into a single system and may include elements of either system. The ECM 120 includes a temperature determination module 302, a tilt determination module 304, a drain time determination module 306, a level determination module 308, and a level storage module 310.

The temperature determination module 302 determines an oil temperature. The temperature determination module 302 may determine the oil temperature based on the oil temperature signal and a predefined relationship between the oil temperature signal and the oil temperature. This relationship may be embodied as an equation and/or a lookup table. Alternatively, the temperature determination module 302 may determine the oil temperature based on vehicle operating conditions, such as an ambient temperature and an engine-on time (i.e., a time during which the engine 102 is switched on). The temperature determination module 302 outputs the oil temperature.

The tilt determination module 304 determines the tilt of the vehicle with respect to gravity. The tilt determination module 304 may determine the vehicle tilt based on the vehicle tilt signal and a predefined relationship between the vehicle tilt signal and the vehicle tilt. This relationship may be embodied as an equation and/or a lookup table. The tilt determination module 304 outputs the vehicle tilt.

The drain time determination module 306 determines a drain time. The drain time is a time (e.g., between 2 and 30 minutes) during which oil is allowed to drain back into the oil reservoir 118 while the engine 102 is off. The drain time determination module 306 may determine the drain time based on the oil temperature, an engine type, and/or an oil viscosity grade. The drain time determination module 306 may determine the drain time using an equation and/or a lookup table relating one or more of these factors to the drain time. The drain time determination module 306 outputs the drain time.

The oil viscosity grade is the viscosity of oil at a reference temperature. The oil viscosity grade may affect the drain time because oil having a higher viscosity grade drains slower than oil having a lower viscosity grade. The oil temperature may affect the drain time because oil viscosity is directly related to oil temperature. Thus, as oil is heated, the viscosity of the oil decreases and the oil drains faster. Conversely, as the oil is cooled, the viscosity of the oil increases and the oil drains slower. The engine type may affect the drain time because different engine types may have different oil passage configurations, such as different oil passage diameters, which may affect oil flow.

The level determination module 308 determines the oil level of the engine 102. The level determination module 308 may determine the oil level based on the oil level signal and a predefined relationship between the oil level signal and the oil level. Alternatively, the level determination module 308 may determine the oil level based on the oil level signal, the oil temperature, and a predefined relationship between the oil level signal, the oil temperature, and the oil level. These relationships may be embodied as an equation and/or a lookup table. The level determination module 308 outputs the oil level.

The level determination module 308 may determine the oil level at predetermined times and/or when instructed to do so by the level storage module 310. The predetermined times may be specified in terms of vehicle miles (e.g., every 500 miles), the number of hours that the engine 102 has operated (e.g., every 10 hours), and/or the number of times that the engine 102 switched off (e.g., every 5 times).

In addition, the level determination module 308 may determine the oil level when oil monitoring conditions satisfy certain criteria, such as when the engine 102 is switched off and the vehicle is level. For example, the level determination module 308 may determine the oil level when the oil temperature is greater than a predetermined temperature, the engine-off time is greater than a drain time, and/or the vehicle tilt is less than a predetermined angle (e.g., 30 degrees). The level determination module 308 may receive the engine-off time from the UIM 128 via the level storage module 310 or the level determination module 308 may receive the engine-off time directly from the UIM 128.

The level storage module 310 stores the oil level and outputs the oil level to the UIM 128 based on the oil level request. When the oil level request is a previous oil level request, the level storage module 310 may output a previous oil level to the UIM 128. The previous oil level may be the oil level most recently measured. When the oil level request is a present oil level request, the level storage module 310 may inform the UIM 128 that the ECM 120 accepts the present level request. In addition, the level storage module 310 may instruct the level determination module 308 to determine a present oil level. In response, the level determination module 308 may determine the present oil level and may output the present oil level to the level storage module 310. The level storage module 310 may then output the present oil level to the UIM 128.

Figure 4:
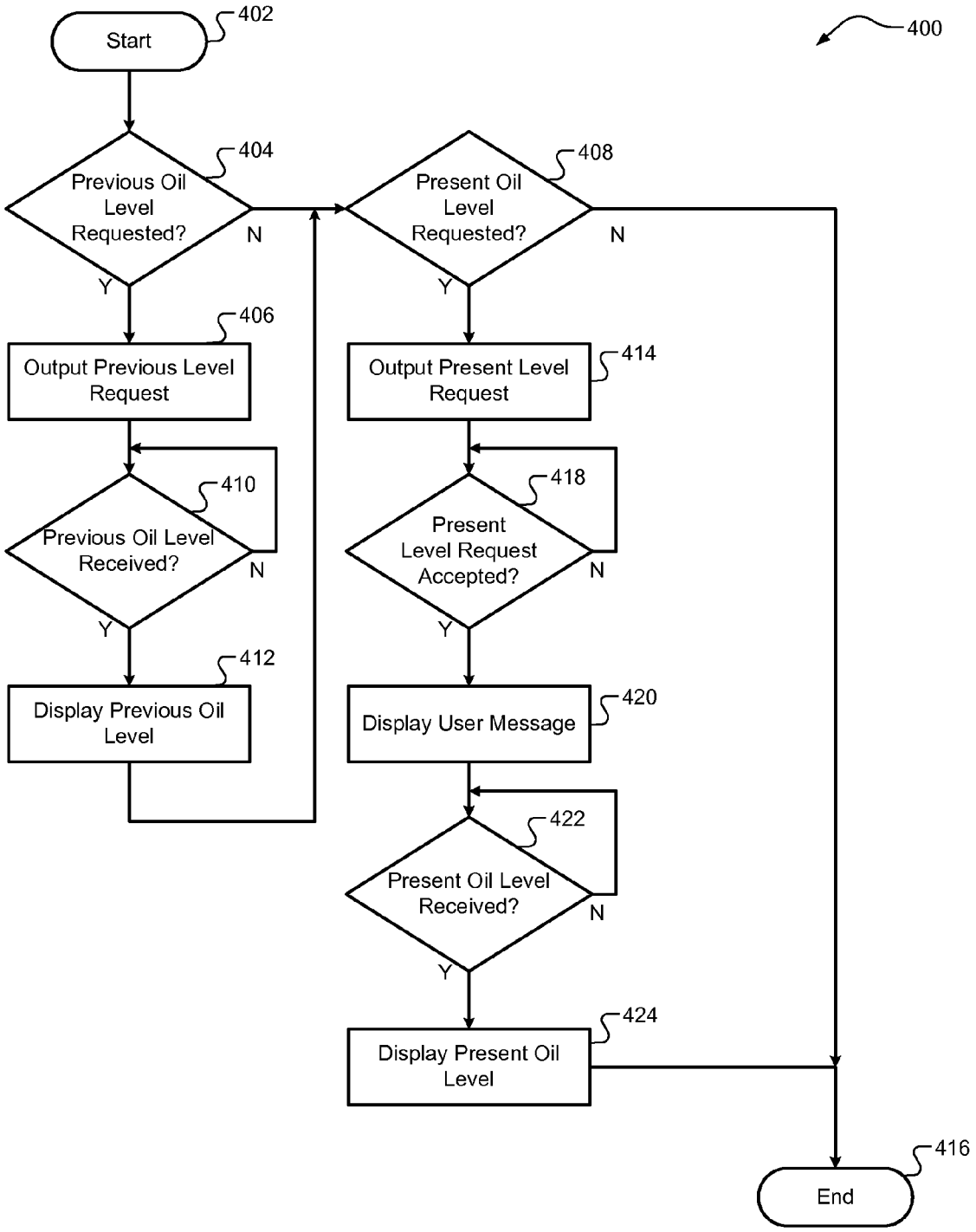
FIGS. 4 and 5 are flowcharts illustrating an example method for monitoring engine oil according to the principles of the present disclosure.

Referring now to FIG. 4, an engine oil monitoring method 400 begins at 402. The method 400 may be executed by the UIM 128. At 404, the method 400 determines whether a user has requested a previous oil level. The previous oil level may be the oil level most recently measured. If 404 is true, the method 400 continues at 406. Otherwise, the method 400 continues at 408.

At 406, the method 400 outputs a previous level request to a vehicle module, such as an ECM, using a wired or wireless signal. At 410, the method 400 determines whether the previous oil level is received from the vehicle module. If 410 is true, the method 400 continues at 412. At 412, the method 400 displays the previous oil level. The method 400 may also display the date, time, and vehicle mileage corresponding to the previous oil level.

At 408, the method 400 determines whether a user has requested a present oil level. If 408 is true, the method 400 continues at 414. Otherwise, the method 400 ends at 416. At 414, the method 400 outputs a present level request to the vehicle module. The method 400 may output the previous level request using a wired or wireless signal. At 418, the method 400 determines whether the present level request is accepted by the vehicle module. If 418 is true, the method 400 continues at 420 and displays a message, which may instruct the user to park the vehicle on level ground and inform the user that an oil level check will occur at the next opportunity after key-off.

At 422, the method 400 determines whether the present oil level is received from the vehicle module. If 422 is true, the method 400 continues at 424. At 424, the method 400 displays the present oil level. The method 400 may also display the date, time, and vehicle mileage corresponding to the previous oil level.

Figure 5:
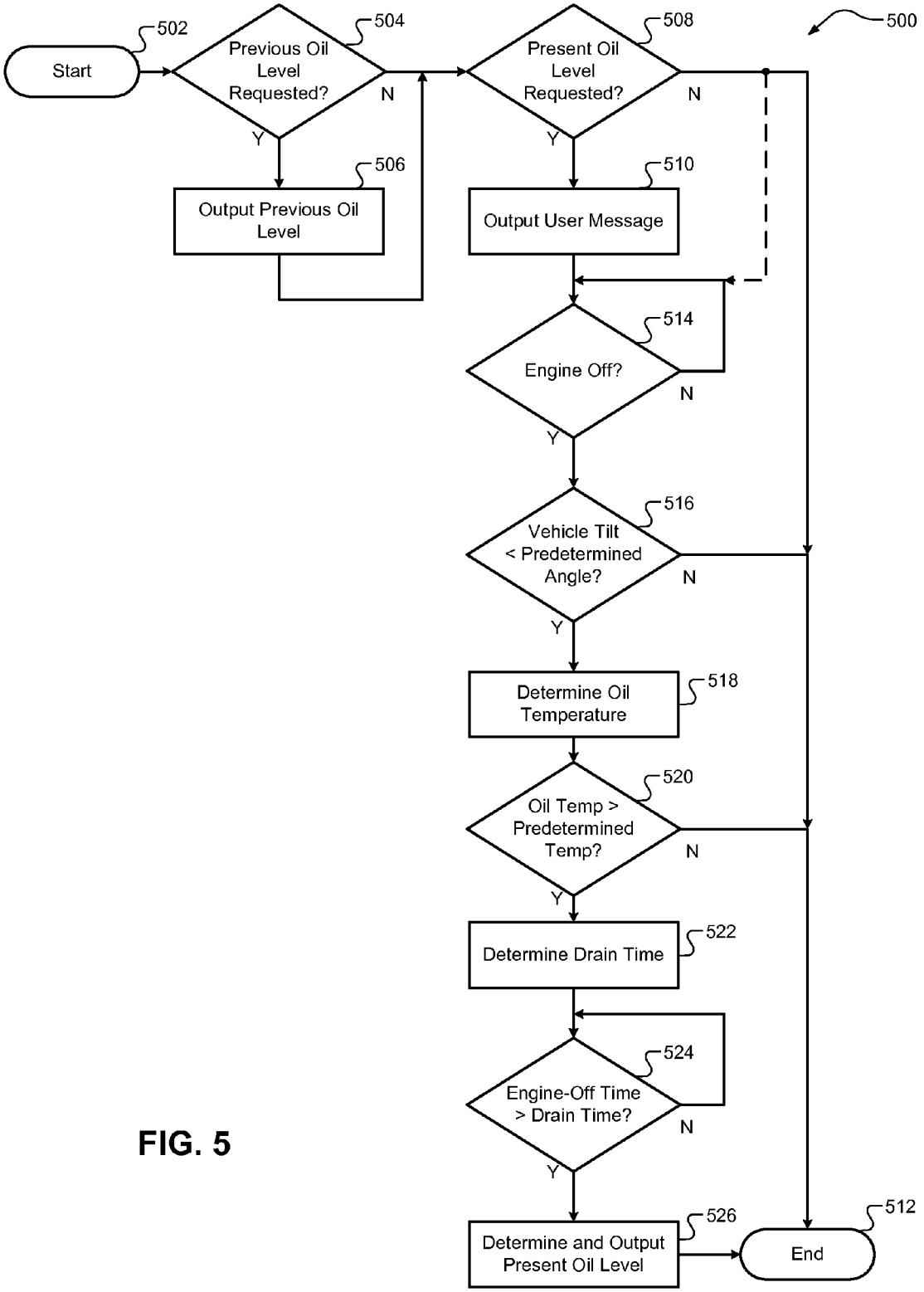

Referring now to FIG. 5, an engine oil monitoring method 500 begins at 502. The methods 400, 500 may be integrated into a single method and may include steps of either method. The method 500 may be executed by the ECM 120. At 504, the method 500 determines whether a previous oil level is requested. The previous oil level may be the oil level most recently measured. If 504 is true, the method 500 continues at 506. Otherwise, the method 500 continues at 508.

At 506, the method 500 outputs the previous oil level. The method 500 may output the previous oil level to a vehicle module and/or to a module that is remote from a vehicle using a wired or wireless signal. The vehicle module may be included in an instrument panel. The remote module may be included in a mobile device, a laptop, and/or a desktop computer. The method 500 may also output the date, time, and vehicle mileage corresponding to the previous oil level.

At 508, the method 500 determines whether a present oil level is requested. If 508 is true, the method 500 continues at 510. Otherwise, the method 500 ends at 512. At 510, the method 500 outputs a user message acknowledging the present level request. The method 500 may output the user message to the vehicle module and/or the remote module. The user message may be displayed on the instrument panel, the mobile device, the laptop, and/or the desktop.

At 514, the method 500 determines whether an engine is switched off. If 514 is true, the method 500 continues at 516. At 516, the method 500 determines whether a vehicle tilt is less than a predetermined angle (e.g., 30 degrees). If 516 is true, the method 500 continues at 518. Otherwise, the method 500 ends at 512.

At 518, the method 500 determines an oil temperature. The method 500 may determine the oil temperature using a temperature sensor. At 520, the method 500 determines whether the oil temperature is greater than a predetermined temperature. The predetermined temperature may be a temperature (e.g., zero degrees Celsius) below which an oil level sensor does not function properly. If 520 is true, the method 500 continues at 522.

At 522, the method 500 determines a drain time. The drain time is a time during which oil is allowed to drain into an oil reservoir while the engine is switched off. The method 500 may determine the drain time based on the oil temperature, an engine type, and/or an oil viscosity grade. At 524, the method 500 determines whether an engine-off time is greater than the drain time. If 524 is true, the method 500 continues at 526.

At 526, the method 500 determines the present oil level and outputs the present oil level. The method 500 may determine the present oil level using an oil level sensor. In addition, the method 500 may determine the present oil level based on the oil temperature. The method 500 may store the present oil level in non-volatile memory.

At predetermined times, if 508 is false, the method may continue at 514 rather than end at 512. The predetermined times may be specified in terms of vehicle miles, a number of hours that an engine is operated, and/or a number of times that the engine is switched off. If 514, 516, 520, and 524 are true, the method 500 may continue at 526. At 526, the method 500 may determine an oil level and store the oil level in non-volatile memory. At 506, the method 500 may output the oil level as the previous oil level if the oil level is the most recently stored oil level in the non-volatile memory.

The broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A system comprising:

a user interface module that outputs an oil level request independent of an ignition switch of an engine;

a level determination module that:

determines whether an oil monitoring condition is satisfied in response to the oil level request, wherein the oil monitoring condition relates to at least one of an oil temperature of the engine and a vehicle tilt with respect to gravity; and measures an oil level of the engine using an oil level sensor when the ignition switch of the engine is switched off and the oil temperature is greater than a predetermined temperature, wherein the oil level sensor does not function properly when the oil temperature is less than the predetermined temperature; and a level storage module that stores the engine oil level in non-volatile memory and that outputs the engine oil level in response to the oil level request.

2. The system of claim 1 further comprising the oil level sensor, wherein the oil level sensor outputs an oil level signal indicating the engine oil level; and the level determination module measures the engine oil level based on the oil level signal.

3. The system of claim 2 wherein the oil level sensor transmits an ultrasonic wave into oil in an oil reservoir of the engine and measures the engine oil level based on a period that elapses while the ultrasonic wave is reflected back to the oil level sensor from a top surface of the oil.

4. The system of claim 1 further comprising a temperature determination module that determines the oil temperature of the engine, wherein the level determination module measures the engine oil level based on the oil temperature.

5. The system of claim 4 further comprising a temperature sensor that measures the oil temperature and outputs an oil temperature signal indicating the oil temperature, wherein the temperature determination module determines the oil temperature based on the oil temperature signal.

6. The system of claim 4 further comprising a time determination module that determines a drain time during which oil is allowed to drain into an oil reservoir of the engine, wherein the level determination module measures the engine oil level when an engine-off time is greater than the drain time.

7. The system of claim 6 wherein the time determination module determines the drain time based on at least one of the oil temperature, an engine type, and an oil viscosity grade.

8. The system of claim 1 further comprising a tilt determination module that determines the vehicle tilt with respect to gravity, wherein the level determination module measures the engine oil level when the vehicle tilt is less than a predetermined angle.

9. The system of claim 1 wherein the oil level request and the oil level are communicated using a wireless signal.

10. The system of claim 1 further comprising a display determination module that, in response to the oil level request, controls a display to display a message instructing a user to park a vehicle on level ground and informing the user that an oil check is scheduled to occur after the engine is shutoff.

11. The system of claim 1 wherein the user interface module outputs the oil level request in response to an input received from at least one of a touchscreen, a mobile device, a laptop computer, and a desktop computer.

12. A method comprising:

outputting an oil level request independent of an ignition switch of an engine;

determining whether an oil monitoring condition is satisfied in response to the oil level request, wherein the oil monitoring condition relates to at least one of an oil temperature of the engine and a vehicle tilt with respect to gravity;

measuring an oil level of the engine using an oil level sensor when the ignition switch of the engine is switched off and the oil temperature is greater than a predetermined temperature, wherein the oil level sensor does not function properly when the oil temperature is less than the predetermined temperature;

storing the engine oil level in non-volatile memory; and outputting the engine oil level in response to the oil level request.

13. The method of claim 12 wherein the oil level sensor outputs an oil level signal indicating the engine oil level, the method further comprising measuring the engine oil level based on the oil level signal.

14. The method of claim 13 wherein the oil level sensor transmits an ultrasonic wave into oil in an oil reservoir of the engine and measures the engine oil level based on a period that elapses while the ultrasonic wave is reflected back to the oil level sensor from a top surface of the oil.

15. The method of claim 12 further comprising:

determining the oil temperature of the engine; and measuring the engine oil level based on the oil temperature.

16. The method of claim 15 further comprising:

outputting an oil temperature signal indicating the oil temperature; and determining the oil temperature based on the oil temperature signal.

17. The method of claim 15 further comprising:

determining a drain time during which oil is allowed to drain into an oil reservoir of the engine; and measuring the engine oil level when an engine-off time is greater than the drain time.

18. The method of claim 17 further comprising determining the drain time based on at least one of the oil temperature, an engine type, and an oil viscosity grade.

19. The method of claim 12 further comprising:

determining the vehicle tilt with respect to gravity; and measuring the engine oil level when the vehicle tilt is less than a predetermined angle.

20. The method of claim 12 wherein the oil level request and the oil level are communicated using a wireless signal.

21. The method of claim 12 further comprising, in response to the oil level request, controlling a display to display a message instructing a user to park a vehicle on level ground and informing the user that an oil check is scheduled to occur after the engine is shutoff.

22. The method of claim 12 further outputting the oil level request in response to an input received from at least one of a touchscreen, a mobile device, a laptop computer, and a desktop computer.

* * * * *